US011920298B2

(12) United States Patent
Khodaei

(10) Patent No.: US 11,920,298 B2
(45) Date of Patent: Mar. 5, 2024

(54) PROCESS AND SYSTEM FOR CONTROLLING TEMPERATURE OF A CIRCULATING FOAMED FLUID

(71) Applicant: Kimberly-Clark Worldwide, Inc., Neenah, WI (US)

(72) Inventor: Aisan Khodaei, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 18/257,359

(22) PCT Filed: Aug. 31, 2021

(86) PCT No.: PCT/US2021/048321

§ 371 (c)(1),
(2) Date: Jun. 14, 2023

(87) PCT Pub. No.: WO2023/033793

PCT Pub. Date: Mar. 9, 2023

(65) Prior Publication Data

US 2023/0399799 A1 Dec. 14, 2023

(51) Int. Cl.

| | |
|---|---|
| ***D21H 21/56*** | (2006.01) |
| ***D21F 1/66*** | (2006.01) |
| ***D21F 9/00*** | (2006.01) |
| ***D21F 11/00*** | (2006.01) |
| ***D21H 13/08*** | (2006.01) |
| ***D21H 21/18*** | (2006.01) |
| ***D21H 27/00*** | (2006.01) |

(52) U.S. Cl.

CPC ..... *D21F 11/002* (2013.01); *D21F 1/66* (2013.01); *D21F 9/00* (2013.01); *D21H 13/08* (2013.01); *D21H 21/18* (2013.01); *D21H 21/56* (2013.01); *D21H 27/002* (2013.01)

(58) Field of Classification Search

CPC . D21F 11/002; D21F 1/66; D21F 9/00; D21H 3/08; D21H 21/18; D21H 21/56; D21H 27/002

USPC ..... 162/100

See application file for complete search history.

(56) References Cited

U.S. PATENT DOCUMENTS

| | | | |
|---|---|---|---|
| 4,662,433 | A | 5/1987 | Cahn et al. |
| 6,086,714 | A | 7/2000 | Plaskon et al. |
| 6,513,580 | B1 | 2/2003 | Bourdel |

FOREIGN PATENT DOCUMENTS

| | | | |
|---|---|---|---|
| AU | 2016350039 | B2 | 12/2019 |
| CN | 203550664 | U | 4/2014 |
| CN | 203980243 | U | 12/2014 |
| CN | 210638545 | U | 5/2020 |
| EP | 0069025 | A1 | 1/1983 |
| JP | H0824510 | A | 1/1996 |

(Continued)

OTHER PUBLICATIONS

PCT Search Report Corresponding to Application No. PCT/US2021/048321 dated Jan. 4, 2022.

(Continued)

*Primary Examiner* — Mark Halpern
(74) *Attorney, Agent, or Firm* — Dority & Manning, P.A.

(57) ABSTRACT

A method and system are disclosed for actively cooling a fluid, particularly a foamed fluid. The foamed fluid may comprise a foamed suspension of fibers that is used to form a web. The foamed suspension of fibers is fed around a recirculation loop and actively cooled using a heat exchanger.

21 Claims, 4 Drawing Sheets

(56) References Cited

FOREIGN PATENT DOCUMENTS

WO WO2021138393 A1 7/2021

OTHER PUBLICATIONS

Fares et al., Heat transfer analysis of a shell and tube heat exchanger operated with graphene nanofluids, Case Studies in Thermal Engineering, vol. 18, 100584, 2020, 8 pages., https://doi.org/10.1016/j.csite.2020.100584.

PROCESS AND SYSTEM FOR CONTROLLING TEMPERATURE OF A CIRCULATING FOAMED FLUID

RELATED APPLICATIONS

The present application is the national stage entry of International Patent Application No. PCT/US2021/048321 having a filing date of Aug. 31, 2021, which is incorporated herein in its entirety by reference thereto.

BACKGROUND

Many tissue products, such as facial tissue, bath tissue, paper towels, industrial wipers, and the like, are produced according to a wet laid process. Wet laid webs are made by depositing an aqueous suspension of pulp fibers onto a forming fabric and then removing water from the newly-formed web.

In order to improve various characteristics of tissue webs, webs have also been formed according to a foam forming process. During a foam forming process, a foamed suspension of fibers is created and spread onto a moving porous conveyor for producing an embryonic web. Foam formed webs can demonstrate improvements in bulk, stretch, caliper, and/or absorbency.

In addition to tissue webs, foam forming can be used to make all different types of webs and products. For example, relatively long fibers and synthetic fibers can be incorporated into webs using a foam forming process. Thus, foam forming processes can be more versatile than many wet laid processes. In fact, foam forming processes can be used to produce all different types of nonwoven webs including webs made primarily from synthetic fibers with lower bulk characteristics.

During a foam forming process, the foamed suspension of fibers is typically produced by combining water and a foaming agent with a fiber furnish. The foaming agent, for instance, can be a surfactant. The water, foaming agent and fibers are mixed together and agitated for creating the foam. In order to prevent the foam from degrading prior to forming the web, the foamed suspension of fibers can be continuously blended or agitated. Continuously agitating the foamed suspension of fibers, however, can cause the foamed suspension of fibers to increase in temperature. Over time, temperatures can increase and build which can interfere with the ability to produce webs.

In view of the above, a need currently exists for a process and system for controlling the temperature of a foam during a foam forming process.

SUMMARY

In general, the present disclosure is directed to a process and system for controlling temperatures in a foam forming process. The foam forming process can be used to produce various different products and articles, including webs. For instance, the foam forming process can be used to produce all different types of nonwoven webs, tissue webs, and the like. The process and system of the present disclosure is directed to maintaining a fiber furnish contained in a foamed suspension with uniform and excellent foam properties while also controlling the temperature of the foam. In this manner, the process and system of the present disclosure can be used to produce webs with optimum properties.

In one embodiment, for instance, the present disclosure is directed to a process for producing a web. The process includes forming a foamed suspension of fibers and depositing at least a portion of the foamed suspension of fibers onto a forming surface for producing the web. In accordance with the present disclosure, at least a portion of the foamed suspension of fibers is fed through a recirculation loop in order to maintain the suspension of fibers in a foamed state. While flowing through the recirculation loop, the process of the present disclosure further includes the step of actively cooling the foamed suspension of fibers. For example, in one aspect, the foamed suspension of fibers can be maintained below a preset temperature while flowing through the recirculation loop. The preset temperature, for instance, can be below about 55° C., such as below about 50° C., such as below about 45° C., such as below about 40° C., such as below about 35° C., such as below about 30° C.

In one embodiment, the foamed suspension of fibers are actively cooled by being fed through a heat exchanger. The heat exchanger, for instance, can be a shell and tube-type heat exchanger wherein the foamed suspension flows through at least one tube in the heat exchanger and is surrounded by a cooling fluid, such as water. The cooling fluid can flow through the heat exchanger in a direction opposite than the direction of flow or in the same direction of flow of the foamed suspension of fibers. During the process, the foamed suspension of fibers can be cooled by at least 3° C., such as by at least 5° C., such as by at least about 8° C.

The foamed suspension of fibers can contain cellulosic fibers, synthetic fibers, and mixtures thereof. In one aspect, the foamed suspension of fibers only contains pulp fibers, such as softwood fibers. In an alternative embodiment, the foamed suspension of fibers can comprise a mixture of pulp fibers and polymer synthetic fibers, such as polyester fibers or polyolefin fibers. In still another embodiment, the foamed suspension of fibers can contain only synthetic polymer fibers.

The foamed suspension of fibers can be formed by combining a fiber furnish with water and a foaming agent, such as a surfactant. The surfactant can comprise sodium dodecyl sulfate, ammonium lauryl sulfate, a fatty acid amine, an amine oxide, a fatty acid quaternary compound, an alkyl polyglycoside, lauryl sulfate, or mixtures thereof.

In one embodiment, the recirculation loop can be in communication with a mixing tank. The mixing tank can be configured to receive water, surfactant and a fiber furnish in order to form the foamed suspension of fibers. The mixing tank can be in communication with a web forming process for feeding the foamed suspension of fibers to the forming surface. As the foamed suspension of fibers is fed to the forming surface, water, surfactant and a fiber furnish can be fed to the mixing tank for maintaining the foamed suspension of fibers at a desired volume level within the tank. The foamed suspension of fibers can contain at least 20% by volume air. For instance, the foamed suspension of fibers can contain at least about 25% by volume, such as at least about 30% by volume, such as at least about 35% by volume of air.

In one embodiment, the process can operate such that the foamed suspension of fibers are only actively cooled after achieving a certain cooling initiation temperature. The cooling initiation temperature, for instance, can be greater than about 30° C., such as greater than about 40° C., such as greater than about 45° C., such as greater than about 50° C., and generally less than about 60° C.

The present disclosure is also directed to a system for forming a web. The system includes a mixing tank for holding a foamed suspension of fibers. The mixing tank is in fluid communication with a water supply, a surfactant supply, and a fiber supply for receiving and combining water, a surfactant and the fiber furnish. The mixing tank is in fluid communication with a web forming process configured to form a web from the foamed suspension of fibers. The system further includes a recirculation loop. The foamed suspension of fibers are circulated through the recirculation loop. The recirculation loop, for instance, can flow the foamed suspension of fibers from the mixing tank and back to the mixing tank. In accordance with the present disclosure, the system further includes a heat exchanger positioned along the recirculation loop. The heat exchanger receives a flow of the foamed suspension of fiber. The heat exchanger also receives a cooling fluid for cooling the foamed suspension of fiber. In one embodiment, the heat exchanger can be a shell and tube-type heat exchanger wherein the foamed suspension of fibers is fed through at least one tube which is surrounded by the cooling fluid.

In one embodiment, the system can include a temperature sensing device and a controller. The controller, for instance, can be any suitable programmable device, such as a microprocessor. The temperature sensing device can determine the temperature of the foamed suspension of fibers and can be configured to communicate the temperature information to the controller. The controller, based on the temperature information received from the temperature sensing device, can control flow of the cooling fluid through the heat exchanger in order to maintain the temperature of the foamed suspension of fibers below a desired temperature. For instance, the system can be used to maintain the temperature of the foamed suspension of fibers below 50° C., such as below 40° C.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
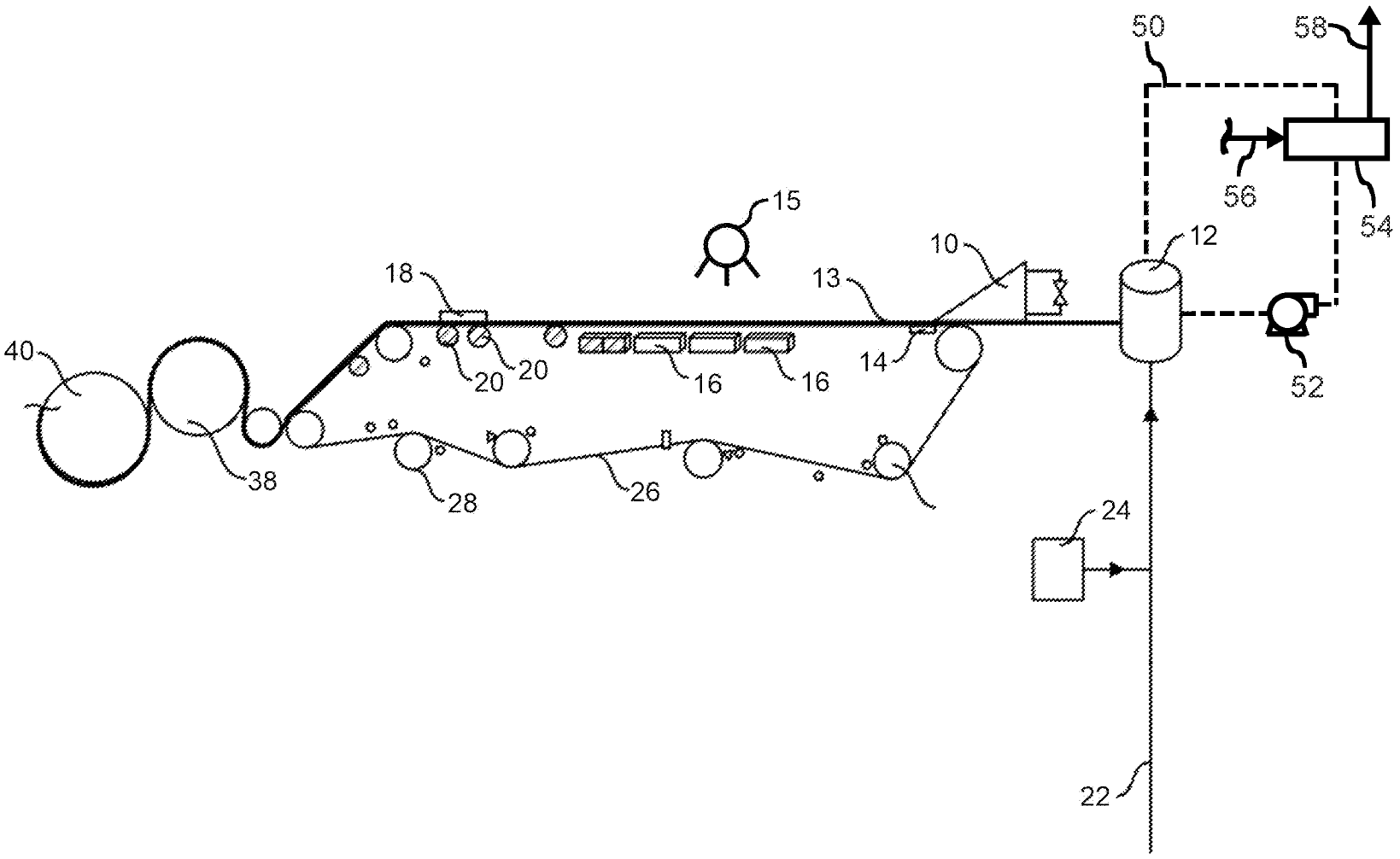
FIG. 1 is one embodiment of a web making system in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only and is not intended as limiting the broader aspects of the present disclosure.

In general, the present disclosure is directed to a system and process for forming webs by first generating a foamed suspension of fibers and then depositing the foamed suspension of fibers onto a forming surface. All different types of webs can be formed in accordance with the present disclosure. Such webs can include webs made primarily from cellulose fibers, such as tissue webs, and webs made primarily from synthetic fibers, such as various other nonwoven webs. In producing the webs from a foamed suspension of fibers, maintaining the foam in a uniform state with desired characteristics can greatly facilitate formation of the webs and can enhance various properties of the webs. In addition, maintaining a uniform foam composition produces webs with uniform properties.

In order to control foam properties, the foamed suspension of fibers can be formed in a tank and then pumped around a recirculation loop. The recirculation loop can not only control and maintain foam properties but can also promote homogeneous distribution of the fibers within the foam. During travel around the recirculation loop, however, the foamed suspension of fibers can increase in temperature. In fact, in certain arrangements, the foamed suspension of fibers can increase greater than 1° C., such as greater than about 2° C., such as even greater than about 3° C. every hour. This increase in temperature can lead to various drawbacks. For instance, foam quality and uniformity can be compromised as the temperature increases. In addition, pressure within the system can increase which can cause various components within the system to fail.

One method for reducing temperature in the recirculation loop is to periodically add new sources of water in combination with adding more foaming agent and removing similar volumes of the foamed suspension of fibers. This method, however, has been found to be ineffective. For instance, temperature increases can still occur. In addition, the above technique is highly inefficient and leads to significant waste.

In this regard, the present disclosure is directed to a system and method for controlling the temperature of the foamed suspension of fibers. More particularly, the system and process of the present disclosure is directed to actively cooling the foamed suspension of fibers using one or more heat exchangers as the foamed suspension of fibers is circulated or pumped around the recirculation loop. In fact, it was discovered that the system and process of the present disclosure not only can effectively cool the foamed suspension of fibers but can also be used to maintain the temperature of the foamed suspension of fibers within carefully controlled preset limits and tolerances.

Although the method and system of the present disclosure can be used in any suitable process or environment, in one aspect, the method and system of the present disclosure can be used to produce webs while maintaining a foamed suspension of fibers with controlled properties. For example, the process can be a papermaking or tissue making process or a process for producing a component of an absorbent article. For exemplary and demonstrative purposes only, referring to FIG. 1, one embodiment of a papermaking or tissue making process is illustrated. The process illustrated in FIG. 1 is a partial view of a process for producing high bulk tissue products, such as facial tissue, bath tissue, paper towels, and the like. The process illustrated in FIG. 1 can also be used as the basis for producing all different types of webs, such as nonwoven webs made from synthetic fibers. It should be understood that the method of the present disclosure can be used in all different types of processes. Merely for exemplary purposes, however, the process illustrated in FIG. 1 will be described as a process for producing webs containing cellulose fibers.

In forming tissue webs, a fiber furnish that contains cellulosic fibers is combined with water to form an aqueous suspension of fibers. The aqueous suspension of fibers is then deposited onto a forming surface for forming a web that is then conveyed downstream, optionally subjected to further processes, and ultimately dried and wound into a roll. One or more surfactants are commonly added to the aqueous suspension of fibers in order to provide various benefits and advantages. The surfactant, for instance, can increase the wettability of the fibers and/or create a better and more uniform dispersion of fibers.

In one embodiment, the surfactant can serve as a foaming agent that forms a foam. The fibers are contained in the foam and then deposited onto the forming surface. Thus, as opposed to liquid water, the carrier is a foam for the fibers. The foam can contain a large quantity of air. In foam forming processes, less water is used to form the web and thus less energy is required in order to dry the web.

During a foam-forming process, a surfactant or foaming agent is combined with water generally in an amount greater than about 0.001% by weight, such as greater than about 0.05% by weight, such as greater than about 2% by weight, such as in an amount greater than about 5% by weight, such as in an amount greater than about 10% by weight, such as in an amount greater than about 15% by weight. One or more foaming agents are generally present in an amount less than about 50% by weight, such as in an amount less than about 40% by weight, such as in an amount less than about 30% by weight, such as in an amount less than about 20% by weight. In one aspect, surfactant concentrations can be kept at low amounts such as from 0.001% to about 1% by weight. For example, in one embodiment the surfactant levels are maintained between about 200 ppm and 2000 ppm, such as between about 300 ppm and 1500 ppm.

Once the foaming agent and water are combined, the mixture is blended or otherwise subjected to forces capable of forming a foam. A foam generally refers to a porous matrix, which is an aggregate of hollow cells or bubbles which may be interconnected to form channels or capillaries.

The foam density can vary depending upon the particular application and various factors including the fiber furnish used. In one embodiment, for instance, the foam density of the foam can be greater than about 200 g/L, such as greater than about 250 g/L, such as greater than about 300 g/L. The foam density is generally less than about 600 g/L, such as less than about 500 g/L, such as less than about 400 g/L, such as less than about 350 g/L. In one embodiment, for instance, a lower density foam is used having a foam density of generally less than about 350 g/L, such as less than about 340 g/L, such as less than about 330 g/L. The foam will generally have an air content of greater than about 30%, such as greater than about 40%, such as greater than about 50%, such as greater than about 60%. The air content is generally less than about 80% by volume, such as less than about 70% by volume, such as less than about 65% by volume.

Surfactants that may be incorporated into the process include various organic compounds. In one embodiment, a nonionic surfactant is used. The nonionic surfactant, for instance, may comprise an alkyl polyglycoside. In one aspect, for instance, the surfactant can be a C8 alkyl polyglycoside, a C10 alkyl polyglycoside, or a mixture of C8 and C10 alkyl polyglycosides. Other surfactants may comprise sodium dodecyl sulfate, such as sodium lauryl sulfate, sodium laureth sulfate, sodium lauryl ether sulfate, or ammonium lauryl sulfate. In other embodiments, the surfactant may comprise any suitable cationic and/or amphoteric surfactant. For instance, other surfactants include fatty acid amines, amides, amine oxides, fatty acid quaternary compounds, and the like.

The aqueous solution containing the surfactant is combined with cellulosic fibers to form the web. Cellulosic fibers that may be incorporated into the web include but not limited to nonwoody fibers, such as cotton, abaca, kenaf, sabai grass, flax, esparto grass, straw, jute hemp, bagasse, milkweed floss fibers, and pineapple leaf fibers; and woody or pulp fibers such as those obtained from deciduous and coniferous trees, including softwood fibers, such as northern and southern softwood kraft fibers; hardwood fibers, such as eucalyptus, maple, birch, and aspen. Pulp fibers can be prepared in high-yield or low-yield forms and can be pulped in any known method, including kraft, sulfite, high-yield pulping methods and other known pulping methods. Fibers prepared from organosolv pulping methods can also be used.

In one aspect, the web may be made exclusively from cellulosic fibers. Alternatively, cellulosic fibers can be combined with other fibers for increasing strength or for improving one or more properties. For example, the web can also contain any suitable synthetic polymer fiber or any suitable regenerated cellulose fiber. Exemplary polymer fibers that may be incorporated in the web include, for instance, polyester fibers, polyolefin fibers such as polyethylene fibers and/or polypropylene fibers, and mixtures thereof. The polymer fibers can also be bicomponent fibers that include a sheath-core configuration or a side-by-side configuration.

Synthetic cellulose fiber types include rayon in all its varieties and other fibers derived from viscose or chemically-modified cellulose. Chemically treated natural cellulosic fibers can be used such as mercerized pulps, chemically stiffened or crosslinked fibers, or sulfonated fibers. For good mechanical properties in using papermaking fibers, it can be desirable that the fibers be relatively undamaged and largely unrefined or only lightly refined. While recycled fibers can be used, virgin fibers are generally useful for their mechanical properties and lack of contaminants. Mercerized fibers, regenerated cellulosic fibers, cellulose produced by microbes, rayon, and other cellulosic material or cellulosic derivatives can be used. In certain embodiments capable of high bulk and good compressive properties, the fibers can have a Canadian Standard Freeness of at least 200, more specifically at least 300, more specifically still at least 400, and most specifically at least 500.

In one aspect, the web can be made exclusively from synthetic fibers. For instance, synthetic fibers can be present in the web in an amount greater than about 80% by weight, such as in an amount greater than about 90% by weight. When forming webs made from primarily synthetic fibers, some type of bonding process is typically included in the system after the web has been dried. For instance, the synthetic fibers can be bonded using thermal bonding techniques.

In addition to fibers, the web can also contain various other different components and chemicals. For instance, the web can also contain a debonding agent, humectants and plasticizers such as low molecular weight polyethylene glycols and polyhydroxy compounds such as glycerin and propylene glycol. Materials that supply skin health benefits such as mineral oil, aloe extract, vitamin E, silicone, lotions in general and the like may also be incorporated into the finished products.

In general, the products of the present disclosure can be used in conjunction with any known materials and chemicals that are not antagonistic to its intended use. Examples of such materials include but are not limited to odor control agents, such as odor absorbents, activated carbon fibers and particles, baby powder, baking soda, chelating agents, zeolites, perfumes or other odor-masking agents, cyclodextrin compounds, oxidizers, and the like. Superabsorbent particles may also be employed. Additional options include cationic dyes, optical brighteners, humectants, emollients, and the like.

In order to form the base web, the aqueous solution is combined with a selected fiber furnish in conjunction with any auxiliary agents. The suspension of fibers is then pumped to a tank and from the tank is fed to a headbox. FIG. 1, for instance, shows one embodiment of a process in accordance with the present disclosure for forming the web.

Referring to FIG. 1, the aqueous suspension of fibers as described above is formed in a tank 12. As shown in FIG. 1, for instance, the tank 12 can be in communication with a water supply 22 for feeding water to the tank and a surfactant supply 24 for feeding a surfactant to the tank 12. The fiber furnish is fed to the tank 12 and combined with the water and surfactant. The aqueous solution formed by combining the surfactant and water can be agitated and formed into a foam for forming a foamed suspension of fibers.

In one embodiment, once a foamed suspension of fibers is formed in the tank 12, the foamed suspension of fibers is fed to a headbox 10. From the headbox 10, the fiber suspension is issued onto an endless traveling forming fabric 26 supported and driven by rolls 28 in order to form a wet embryonic web 13. As shown in FIG. 1, a forming board 14 may be positioned below the web 13 adjacent to the headbox 10. Once formed on the forming fabric 26, the formed web can have a consistency of less than about 50%, such as less than about 20%, such as less than about 10%, such as less than about 5%. In fact, the forming consistency can be less than about 2%, such as less than about 1.8%, such as less than about 1.5%. The forming consistency is generally greater than about 0.5%, such as greater than about 0.8%.

Once the wet web is formed on the forming fabric 26, the web is conveyed downstream and dewatered. For instance, the process can optionally include a plurality of vacuum devices 16, such as vacuum boxes and vacuum rolls. The vacuum boxes assist in removing moisture from the newly formed web 13.

In one aspect, as shown in FIG. 1, the system can also include one or more spraying devices 15. The spraying devices 15, for instance, can emit an aqueous stream onto the web 13. The aqueous stream can be used to rinse the web in one embodiment or, alternatively, can comprise hydroentangling jets that causes the fibers in the web to hydroentangle and increase the integrity of the web. Aqueous fluids emitted by the spraying device 15 can be drained and collected using any suitable device, such as the vacuum devices 16.

As shown in FIG. 1, the forming fabric 26 may also be placed in communication with a steambox 18 positioned above a pair of vacuum rolls 20. The steambox 18, for instance, can increase dryness and reduce cross-directional moisture variance. The applied steam from the steambox 18 heats the moisture in the wet web 13 causing the water in the web to drain more readily, especially in conjunction with the vacuum rolls 20. From the forming fabric 26, the newly formed web 13 is conveyed downstream and dried. The web can be dried using any suitable drying device. For instance, the web can be through-air dried or placed on a heated drying drum and creped or left uncreped. In FIG. 1, for instance, the formed web 13 is placed in contact with two heated drying drums 38 and 40. In one embodiment, from the drying drums 38 and 40, the web can be fed to a through-air dryer prior to being wound into a roll.

The process of the present disclosure can produce webs with good bulk characteristics if desired. The sheet 'bulk' is calculated as the quotient of the caliper of a dry tissue sheet, expressed in microns, divided by the dry basis weight, expressed in grams per square meter. The resulting sheet bulk is expressed in cubic centimeters per gram. More specifically, the caliper is measured as the total thickness of a stack of ten representative sheets and dividing the total thickness of the stack by ten, where each sheet within the stack is placed with the same side up. Caliper is measured in accordance with TAPPI test method T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oreg. The micrometer has a load of 2.00 kilo-Pascals (132 grams per square inch), a pressure foot area of 2500 square millimeters, a pressure foot diameter of 56.42 millimeters, a dwell time of 3 seconds and a lowering rate of 0.8 millimeters per second.

Webs made according to the present disclosure can be used in all different types of products. For instance, the tissue web can be used to produce bath tissue, facial tissue, paper towels, industrial wipers, personal care products and the like. As described above, the process can also be used to form all different types of other non-woven webs, including webs that primarily contain thermoplastic synthetic fibers.

As shown in FIG. 1, in one embodiment, the tank 12 can be in communication with a recirculation loop 50. The aqueous suspension of fibers is pumped by a pumping device 52 from the tank 12 and around the recirculation loop 50 and back into the tank 12. The recirculation loop 50 promotes a homogeneous distribution of fibers within the foamed suspension. In addition, the recirculation loop 50 can improve the quality and uniformity of the foam. In particular, the recirculation loop 50 prevents the foam from dissipating. Consequently, as the aqueous suspension of fibers is fed from the tank 12 to the headbox 10, the characteristics and properties of the foamed suspension of fibers does not change during running of the process. Maintaining a uniform suspension of fibers produces webs having uniform properties and formation characteristics.

Recirculating the foamed suspension of fibers around the recirculation loop 50, however, can cause the foamed suspension of fibers to increase in temperature. This increase in temperature can change the properties of the foam and increase pressure within the system. In this regard, the present disclosure is directed to actively cooling the foamed suspension of fibers as the foamed suspension of fibers flows through the recirculation loop 50. For example, in one embodiment, the foamed suspension of fibers can be fed through a heat exchanger 54 that not only cools the foamed suspension of fibers but can also be used to maintain the foamed suspension of fibers within a desired temperature range.

Any suitable heat exchanger can be incorporated into the process and system of the present disclosure. In one aspect, for instance, the heat exchanger 54 can be a shell and tube heat exchanger. For instance, the heat exchanger 54 can contain one or more tubes that are surrounded by a hollow shell. The foamed suspension of fibers can be fed through the one or more tubes. Simultaneously, a cooling fluid, such as water, can be fed through the hollow shell. The cooling fluid thus surrounds the foamed suspension of fibers without contacting the foamed suspension of fibers and cools the foamed suspension of fibers through heat conduction. As shown in FIG. 1, for instance, the heat exchanger 54 can include a cooling fluid inlet 56 and a cooled fluid outlet 58 for receiving the cooling fluid. The temperature of the cooling fluid can vary based on the type of cooling fluid used and availability. The temperature of the cooling fluid is less than the temperature of the foamed suspension of fibers. When using water as the cooling fluid, for example, the cooling fluid can be at a temperature of less than about 25 C when entering the heat exchanger. For instance, the cooling fluid can have a temperature of less than about 22 C, such as less than about 20 C, such as less than 18 C, and generally greater than about 10 C.

During the process, the flow rate of the cooling fluid can be modified and controlled in order to control the amount of cooling that takes place within the heat exchanger 54. The flow rate of the cooling fluid can depend on numerous factors including the size of the heat exchanger and the temperature of the foamed suspension of fibers. For exemplary purposes, in one embodiment, the flow rate of the cooling fluid can be between about 10 gpm to about 50 gpm, such as from about 18 gpm to about 40 gpm.

In one embodiment, the heat exchanger 54 includes one or more tubes having an outside diameter of greater than about 0.2 inches, such as greater than about 0.25 inches, such as greater than about 0.3 inches, such as greater than about 0.35 inches. The outside diameter of the one or more tubes can generally be less than about 2 inches, such as less than about 1 inch, such as less than about 0.8 inches, such as less than about 0.6 inches, such as less than about 0.45 inches. The one or more tubes can be made from a heat conductive material, such as a metal.

In one aspect, the foamed suspension of fibers in the recirculation loop 50 can be actively cooled using the heat exchanger 54 such that the foamed suspension of fibers maintains a temperature of less than about 55° C. For example, in various embodiments, the temperature of the foamed suspension of fibers can be maintained below about 50° C., such as below about 45° C., such as below about 40° C., such as below about 35° C., such as below about 30° C. The recirculation loop 50 and the heat exchanger 54 can also maintain the temperature of the foamed suspension of fibers above a desired level. For instance, the foamed suspension of fibers can be maintained at a temperature of greater than about 20° C., such as greater than about 23° C. During the process, the heat exchanger 54 can cool the foamed suspension of fibers by at least about 3° C., such as by at least about 5° C.

In certain embodiments, further controls can be incorporated into the process and system of the present disclosure. For instance, referring to FIG. 2, an alternative embodiment of a recirculation loop in accordance with the present disclosure is shown. Like reference numerals have been used to indicate similar elements. As shown, a recirculation loop 50 is in communication with a mixing tank 12. A pumping device 52 pumps a foamed suspension of fibers from the tank 12 and around the recirculation loop 50. In accordance with the present disclosure, a heat exchanger 54 is positioned along the recirculation loop 50 for actively cooling the foamed suspension of fibers.

Figure 2:
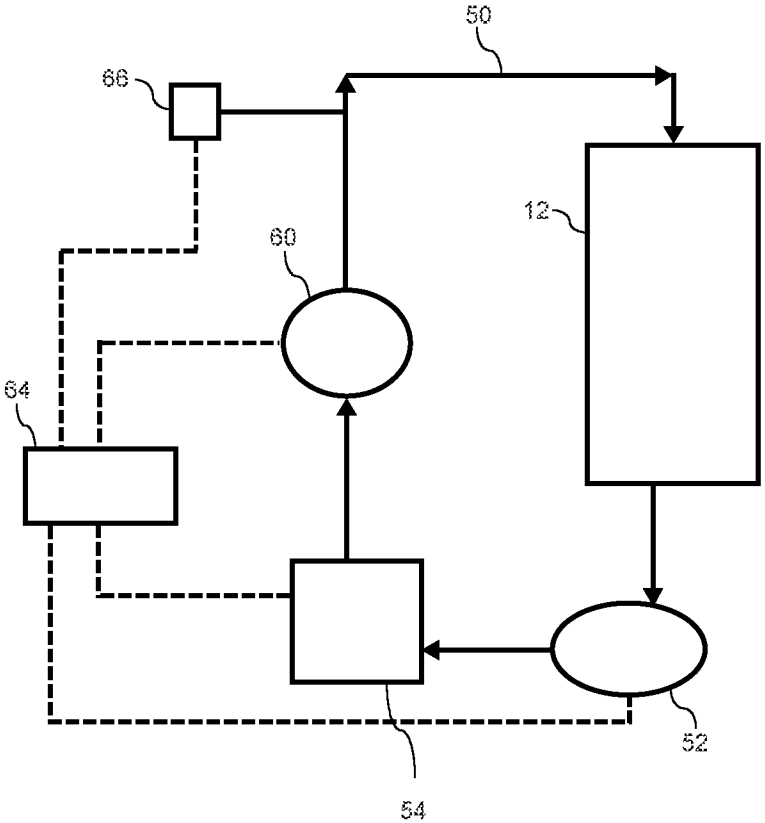
FIG. 2 is one embodiment of a fluid recirculation loop with active cooling in accordance with the present disclosure.

In the embodiment illustrated in FIG. 2, the system further includes a flow meter 60 and a controller 64. As shown, the controller 64 is configured to receive information from the flow meter 60 for determining the flow rate of the foamed suspension of fibers or fluid traveling through the recirculation loop 50. The controller 64 is also in communication with the pump 52 and the heat exchanger 54. The system further includes a temperature sensor 66 that is also in communication with the controller 64.

In the arrangement shown in FIG. 2, the controller can receive flow rate information from the flow meter 60 and make adjustments to the pumping device 54 for pumping the foamed suspension of fibers from the tank 12 at a desired flow rate.

In addition, the controller 64 can be configured to control the heat exchanger based on temperature measurements received from the temperature sensor 66. In one embodiment, for instance, the heat exchanger 54 can be placed in an off position until the temperature of the foamed suspension of fibers in the recirculation loop 50 reaches a certain preset temperature. Once a preset temperature is reached as determined by the temperature sensor 66, the controller 64 can then control flow of a cooling fluid through the heat exchanger 54. The controller can control, for instance, the flow rate and/or the temperature of the cooling fluid being fed through the heat exchanger for maintaining the temperature of the foamed suspension of fibers within preset limits. The controller 64, for instance, can make adjustments to the cooling fluid feed rate continuously based on information received from the temperature sensor 66. The controller can operate, for instance, in an open loop manner or in a closed loop manner. The controller 64, for instance, can maintain the temperature of the foamed suspension of fibers within a predetermined range. The range can be less than about 10° C., such as less than about 8° C., such as less than about 6° C., such as less than about 4° C., such as less than about 2° C.

The controller 64 can be any suitable processor and/or programmable device. The controller 64, for instance, can comprise one or more microprocessors.

In the embodiments illustrated in FIGS. 1 and 2, the system illustrates a single heat exchanger 54. It should be understood, however, that the system can include a plurality of heat exchangers. The heat exchangers, for instance, can be placed in a parallel relationship when flow rates through a single heat exchanger may be insufficient. A plurality of heat exchangers can also be placed in series in order to better control the amount of cooling that takes place.

The present disclosure may be better understood with reference to the following example.

EXAMPLE

A recirculation loop for a foamed suspension of fibers was designed and constructed generally as shown in FIGS. 1 and 2. The system included a pair of shell and tube heat exchangers arranged in parallel. The system was initially run without operating the heat exchangers. The foamed suspension of fibers increased 3.1° C. every hour. The foamed suspension of fibers contained a fiber furnish comprising 65% by weight softwood fibers and 35% by weight polyethylene terephthalate fibers.

Figure 3:
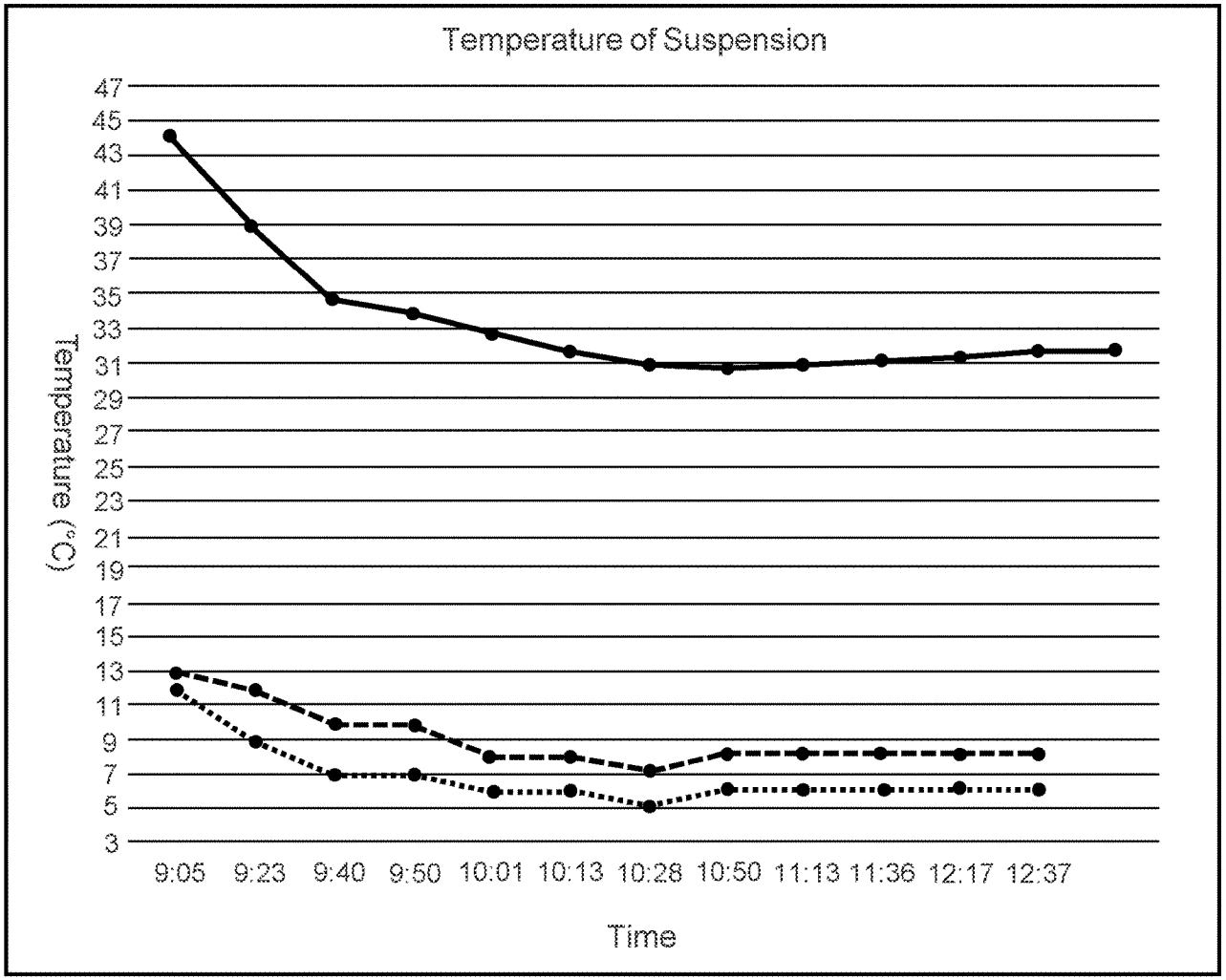
FIG. 3 is a graph of some of the results received in the example below.

The system was operated and the foamed suspension of fibers was circulated over the recirculation loop until the foamed suspension of fibers reached a temperature of 44° C. At this point, both of the heat exchangers were operated to actively cool the foamed suspension of fibers FIG. 3 illustrates the results. As you can see, the cooling fluid fed through the heat exchangers had a temperature difference with the foamed suspension of fibers of generally greater than about 3° C., such as greater than about 4° C., such as greater than about 5° C., and generally less than about 20° C., such as less than about 15° C., such as less than about 14° C. The heat exchangers were capable of cooling the foamed suspension of fibers from about 44° to about 31° C. As shown in FIG. 3, the heat exchangers not only cooled the foamed suspension of fibers but were also able to maintain the temperature of the foamed suspension of fibers between about 31° C. and about 32° C.

Figure 4:
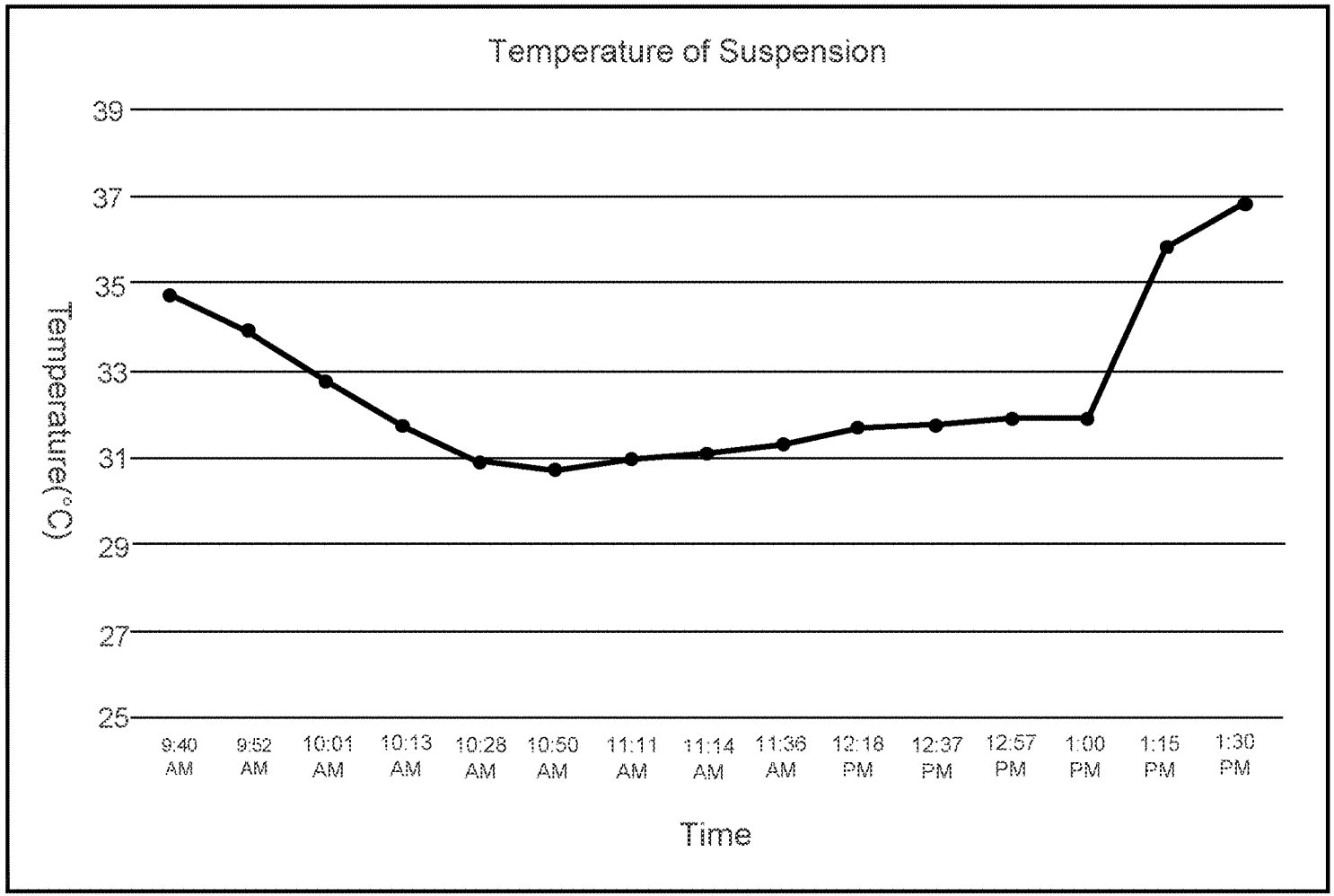
FIG. 4 is a graph illustrating some of the results obtained in the example below.

The heat exchangers were then turned off and the temperature of the foamed suspension of fibers was continued to be measured. The results are shown in FIG. 4. As shown, as soon as the heat exchangers were turned off, the temperature of the foamed suspension of fibers increased from about 32° C. to about 37° C. in less than about 30 minutes.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A process for producing a web comprising:

forming a foamed suspension of fibers;

depositing at least a portion of the foamed suspension of fibers onto a forming surface for producing a web;

flowing at least a portion of the foamed suspension of fibers through a recirculation loop; and actively cooling the foamed suspension of fibers flowing through the recirculation loop, the foamed suspension of fibers being maintained below a preset temperature.

2. A process as defined in claim 1, wherein the foamed suspension of fibers is cooled by being fed through a heat exchanger.

3. A process as defined in claim 2, wherein the heat exchanger includes at least one tube inside of a shell, the foamed suspension of fibers being fed through the at least one tube while a cooling fluid flows over the at least one tube within the shell.

4. A process as defined in claim 3, wherein the cooling fluid comprises water.

5. A process as defined in claim 1, wherein the foamed suspension of fibers within the recirculation loop is maintained at a temperature of less than about 55° C.

6. A process as defined in claim 1, wherein the foamed suspension of fibers comprises cellulose fibers, synthetic fibers, or mixtures thereof.

7. A process as defined in claim 1, wherein the foamed suspension of fibers contains synthetic polymer fibers combined with pulp fibers.

8. A process as defined in claim 1, wherein the foamed suspension of fibers flowing through the recirculation loop is cooled by at least 3° C.

9. A process as defined in claim 1, further comprising the step of monitoring a temperature of the foamed suspension of fibers flowing through the recirculation loop and initiating active cooling of the foamed suspension of fibers after the foamed suspension of fibers has increased to a cooling initiation temperature.

10. A process as defined in claim 1, wherein the foamed suspension of fibers comprises fibers combined with water and a surfactant.

11. A process as defined in claim 10, wherein the surfactant comprises sodium dodecyl sulfate, ammonium lauryl sulfate, a fatty acid amine, an amine oxide, a fatty acid quaternary compound, an alkyl polyglycoside, or lauryl sulfate.

12. A process as defined in claim 1, wherein the foamed suspension of fibers is formed in a mixing tank that forms part of the recirculation loop.

13. A process as defined in claim 12, wherein a water supply and a surfactant supply feed a water and a surfactant into the mixing tank in conjunction with a fiber furnish as at least a portion of the foamed suspension of fibers is deposited onto the forming surface in order to maintain a volume of the foamed suspension of fibers within the mixing tank during the process.

14. A process as defined in claim 1, wherein the foamed suspension of fibers contains greater than about 20% air.

15. A system for forming a web comprising:

a mixing tank for holding a foamed suspension of fibers, the mixing tank in fluid communication with a water supply, a surfactant supply, and a fiber supply for receiving and combining water, a surfactant, and a fiber furnish;

a web forming process configured to receive a foamed suspension of fibers from the mixing tank for forming a web;

a recirculation loop that circulates a foamed suspension of fibers from the mixing tank and back to the mixing tank, the recirculation loop maintaining the fibers in a foamed suspension; and a heat exchanger positioned along the recirculation loop for receiving the foamed suspension of fibers, the heat exchanger also being in fluid communication with a cooling fluid supply for receiving a cooling fluid and wherein the foamed suspension of fibers flow through the heat exchanger along a first pathway while the cooling fluid flows through the heat exchanger along a second pathway for cooling the foamed suspension of fibers.

16. A system as defined in claim 15, wherein the heat exchanger comprises a shell and tube heat exchanger, the aqueous suspension of fibers flowing through at least one tube while the cooling fluid flows through a shell that surrounds the at least one tube.

17. A system as defined in claim 16, wherein the at least one tube has an outside diameter of from about 0.2 inches to about 0.8 inches.

18. A system as defined in claim 15, further comprising a temperature sensing device and a controller, the temperature sensing device being configured to determine a temperature of the foamed suspension of fibers and to communicate temperature information to the controller, the controller, based on the temperature information, being configured to control flow of a cooling fluid through the heat exchanger.

19. A system as defined in claim 18, wherein the controller comprises at least one microprocessor.

20. A system as defined in claim 18, wherein the controller is configured to maintain the temperature of the foamed suspension of fibers below 40° C.

21. A system as defined in claim 15, wherein the system includes at least two heat exchangers arranged in parallel along the recirculation loop.

* * * * *